US011566308B2

(12) United States Patent
Kim et al.

(10) Patent No.: US 11,566,308 B2
(45) Date of Patent: Jan. 31, 2023

(54) AUSTENITIC STEEL MATERIAL HAVING EXCELLENT ABRASION RESISTANCE AND TOUGHNESS AND MANUFACTURING METHOD THE SAME

(71) Applicant: POSCO, Pohang-si (KR)

(72) Inventors: Yong-Jin Kim, Gwangyang-si (KR); Hong-Yeol Oh, Gwangyang-si (KR); Hong-Ju Lee, Pohang-si (KR); Sang-Deok Kang, Gwangyang-si (KR); Yoen-Jung Park, Pohang-si (KR); Young-Deok Jung, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 355 days.

(21) Appl. No.: 16/471,874

(22) PCT Filed: Dec. 21, 2017

(86) PCT No.: PCT/KR2017/015211
§ 371 (c)(1),
(2) Date: Jun. 20, 2019

(87) PCT Pub. No.: WO2018/117676
PCT Pub. Date: Jun. 28, 2018

(65) Prior Publication Data

US 2020/0140981 A1 May 7, 2020

(30) Foreign Application Priority Data

Dec. 23, 2016 (KR) ..... 10-2016-0178235

(51) Int. Cl.
*C22C 38/38* (2006.01)
*C21D 8/02* (2006.01)
(Continued)

(52) U.S. Cl.
CPC ..... *C22C 38/38* (2013.01); *C21D 8/0226* (2013.01); *C21D 9/0062* (2013.01); *C22C 38/02* (2013.01);
(Continued)

(58) Field of Classification Search
None
See application file for complete search history.

(56) References Cited

U.S. PATENT DOCUMENTS

2002/0048529 A1 4/2002 Kucharczyk et al.
2006/0278309 A1 12/2006 Bouzekri et al.
(Continued)

FOREIGN PATENT DOCUMENTS

CN 1846002 A 10/2006
CN 101065503 A 10/2007
(Continued)

OTHER PUBLICATIONS

Dossett, Jon L. Totten, George E.. (2013). ASM Handbook, vol. 04A—Steel heat Treating Fundamentals and Processes—5. Quenching of Steel. ASM International. (Year: 2013).*
(Continued)

*Primary Examiner* — Anthony M Liang
(74) *Attorney, Agent, or Firm* — Morgan, Lewis & Bockius LLP

(57) ABSTRACT

Provided according to one preferred aspect of the present invention are austenitic steel material having superb abrasion resistance and toughness, and a method for producing the austenite steel material. The austenitic steel material having superb abrasion resistance and toughness according to one preferred aspect of the present invention comprises, in wt %, 0.6-1.9% carbon (C); 12-22% manganese (Mn); 5% or lower (excluding 0%) chromium (Cr); 5% or lower (excluding 0%) copper (Cu); 0.5% or lower (excluding 0%)
(Continued)

aluminum (Al); 1.0% or lower (excluding 0%) silicon (Si); 0.1% or lower (including 0%) phosphorous (P); 0.02% or lower (including 0%) sulfur (S); and the rest in Fe and unavoidable impurities, and has the microstructure comprising, by surface area fraction, 97% or higher (including 100%) austenite and 3% or lower (including 0%) carbide.

6 Claims, 1 Drawing Sheet

(51) Int. Cl.

| | |
|---|---|
| ***C21D 9/00*** | (2006.01) |
| ***C22C 38/20*** | (2006.01) |
| ***C22C 38/02*** | (2006.01) |
| ***C22C 38/06*** | (2006.01) |

(52) U.S. Cl.
CPC ..... *C22C 38/06* (2013.01); *C22C 38/20* (2013.01); *C21D 2211/001* (2013.01)

(56) References Cited

U.S. PATENT DOCUMENTS

| | | | |
|---|---|---|---|
| 2008/0035248 | A1 | 12/2008 | Cugy et al. |
| 2009/0010793 | A1 | 1/2009 | Becker et al. |
| 2009/0308499 | A1 | 12/2009 | Scott et al. |
| 2013/0295409 | A1 | 11/2013 | Chin et al. |
| 2014/0261918 | A1 | 9/2014 | Jin et al. |
| 2014/0356220 | A1 | 12/2014 | Lee et al. |
| 2016/0168672 | A1 | 6/2016 | Kobayashi et al. |

FOREIGN PATENT DOCUMENTS

| | | | | |
|---|---|---|---|---|
| CN | 101090982 | A | | 12/2007 |
| CN | 101506402 | A | | 8/2009 |
| CN | 102906294 | A | | 1/2013 |
| CN | 103380434 | A | | 10/2013 |
| CN | 105849302 | A | | 8/2016 |
| EP | 2520684 | A2 | | 11/2012 |
| EP | 3088555 | A1 | | 11/2016 |
| JP | S58-044725 | B2 | | 10/1983 |
| JP | H06-128631 | A | | 5/1994 |
| JP | 2006-118000 | A | | 5/2006 |
| JP | 2011-111666 | A | | 6/2011 |
| JP | 2013-23743 | A | | 2/2013 |
| JP | 2013023743 | A | * | 2/2013 |
| JP | 2013-515864 | A | | 5/2013 |
| JP | 2015-507700 | A | | 3/2015 |
| JP | 2016-512288 | A | | 4/2016 |
| KR | 10-1998-058369 | A | | 9/1998 |
| KR | 10-2009-0043508 | A | | 5/2009 |
| KR | 10-2010-0106649 | A | | 10/2010 |
| KR | 10-2015-0075305 | A | | 7/2015 |
| KR | 10-2016-0075927 | A | | 6/2016 |
| KR | 10-2016-0078664 | A | | 7/2016 |
| WO | 2015/012357 | A1 | | 1/2015 |

OTHER PUBLICATIONS

ASM International Handbook Committee. (1990). ASM Handbook, vol. 01—Properties and Selection: Irons, Steels, and High-Performance Alloys—7.2.1 Hot Rolling. ASM International. (Year: 1990).*

Extended European Search Report dated Oct. 11, 2019 issued in European Patent Application No. 17882436.3.

International Search Report dated Mar. 21, 2018 issued in International Patent Application No. PCT/KR2017/015211 (with English translation).

Chinese Office Action dated Jul. 21, 2020 issued in Chinese patent application No. 201780078825.7 (with English translation).

Japanese Office Action dated Oct. 6, 2020 issued in Japanese patent application No. 2019-533453.

* cited by examiner

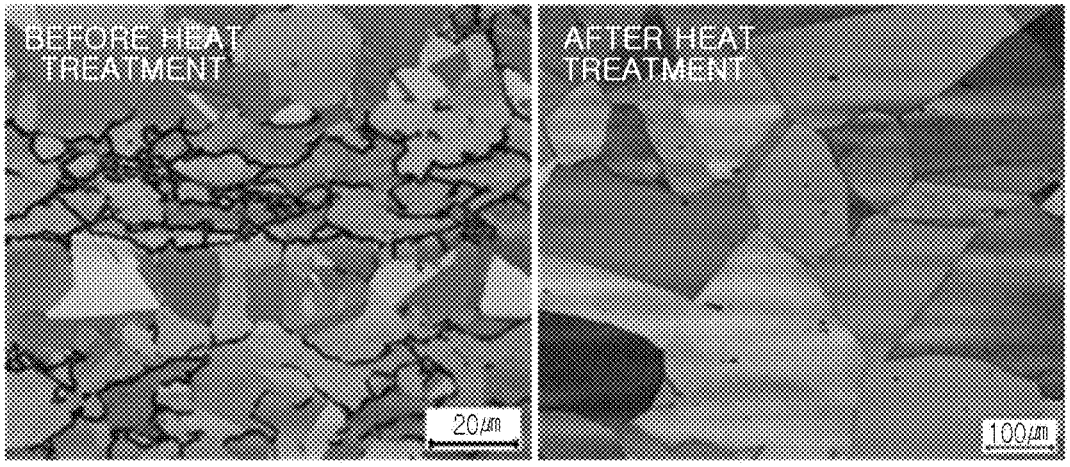
BEFORE HEAT TREATMENT
20μm
AFTER HEAT TREATMENT
100μm

AUSTENITIC STEEL MATERIAL HAVING EXCELLENT ABRASION RESISTANCE AND TOUGHNESS AND MANUFACTURING METHOD THE SAME

CROSS-REFERENCE OF RELATED APPLICATIONS

This application is the U.S. National Phase under 35 U.S.C. § 371 of International Patent Application No. PCT/KR2017/015211, filed on Dec. 21, 2017, which in turn claims the benefit of Korean Application No. 10-2016-0178235, filed on Dec. 23, 2016, the entire disclosures of which applications are incorporated by reference herein.

TECHNICAL FIELD

The present disclosure relates to an austenitic steel material having excellent wear resistance and toughness, and a method of manufacturing the same.

BACKGROUND ART

An austenitic steel material may be used for various purposes due to characteristics thereof such as process hardenability, non-magnetic properties, and the like. Specifically, as carbon steel having ferrite and martensite as a main structure has a limitation in properties thereof, an austenite steel material has been increasingly used as a substitutable material which may overcome disadvantages of the carbon steel.

With the growth of the mining industry and the oil and gas industries, wear of a use steel material has become a significant problem in mining, transporting, refining, and storing processes. As fossil fuels for substituting for petroleum, the development of oil sands has been actively conducted, and wear of a steel material caused by slurry including oil, pebbles, sands, and the like, has been considered an important cause for increasing producing costs. Accordingly, demand for the development and application of a steel material having excellent wear resistance and toughness has increased.

High manganese steel or Hadfield steel has excellent wear resistance, and has thus been widely used as a wear resistance component in various industries. To improve wear resistance of a steel material, there have been constant attempts to increase an austenite structure and abrasion resistance by adding a high content of carbon and including a large amount of manganese.

However, a high content of carbon in high manganese steel may generate carbides formed along a grain boundary at a high temperature such that properties of a steel material, particularly ductility of a steel material, may greatly degrade.

To prevent the precipitation of carbides on a grain boundary described above, a method of manufacturing high manganese steel by performing a water-printing heat treatment or performing a solution treatment at a high temperature, performing a hot working, and performing rapid cooling at room temperature has been suggested.

However, high manganese steel manufactured by the above-described method may have excellent wear resistance in a general mechanical wear environment, but it may be difficult for such high manganese steel to implement wear resistance in an environment accompanying abrasion and wear. Thus, it may be difficult to apply such high manganese steel in a harsh environment in which complex wear of steel may occur.

Thus, it may be necessary to develop an austenite steel material which may secure both of wear resistance and toughness by preventing the formation of carbides based on contents of carbon and manganese.

PRIOR ART (Reference 1) Korean Laid-Open Patent Publication No. 2010-0106649

DISCLOSURE

Technical Problem

An aspect of the present disclosure is to provide an austenitic steel material having excellent wear resistance and toughness.

Another aspect of the present disclosure is to provide a method for manufacturing an austenitic steel material having excellent wear resistance and toughness.

Technical Solution

According to an aspect of the present disclosure, an austenitic steel material having excellent wear resistance and toughness is provided, the austenitic steel material comprising, by wt %, 0.6 to 1.9% of carbon (C), 12 to 22% of manganese (Mn), 5% or less of chromium (Cr) (excluding 0%), 5% or less of copper (Cu) (excluding 0%), 0.5% or less of aluminum (Al) (excluding 0%), 1.0% or less of silicon (Si) (excluding 0%), 0.1% or less of phosphorous (P) (including 0%), 0.02% or less of sulfur (S) (including 0%), and a balance of Fe and inevitable impurities, and comprising, by an area fraction, austenite of 97% or higher (including 100%) and carbides of 3% or lower (including 0%), as a microstructure.

Preferably, a grain size of austenite may be 500 μm or less.

According to another aspect of the present disclosure, a method of manufacturing an austenitic steel material having excellent wear resistance and toughness is provided, the method comprising preparing a slab comprising, by wt %, 0.6 to 1.9% of carbon (C), 12 to 22% of manganese (Mn), 5% or less of chromium (Cr) (excluding 0%), 5% or less of copper (Cu) (excluding 0%), 0.5% or less of aluminum (Al) (excluding 0%), 1.0% or less of silicon (Si) (excluding 0%), 0.1% or less of phosphorous (P) (including 0%), 0.02% or less of sulfur (S) (including 0%), and a balance of Fe and inevitable impurities; reheating the slab at 1050° C. or higher; obtaining a hot-rolled steel material by hot-rolling the reheated slab at a finish rolling temperature of 800° C. or higher; and performing a heat treatment in which the hot-rolled steel material is maintained for a maintaining time (minutes) satisfying Relational Expression 2, at a heat treatment temperature (T) satisfying Relational Expression 1 below, and the hot-rolled steel material is water-cooled to 500° C. or lower at a cooling speed of 10° C./sec or higher, [Relational Expression 1]: $530+285[C]+44[Cr]<T<1446-174[C]-3.9[Mn]$, where T is a heat treatment temperature (° C.), and [C], [Cr] and [Mn] each indicate wt % of each element, and [Relational Expression 2]: $t+10<\text{maintaining time}<t+30$, where T is a thickness of a steel sheet (mm).

Advantageous Effects

According to an aspect of the present disclosure, by controlling carbides in a microstructure through a heat treatment, an austenitic steel material having excellent wear resistance and toughness which may secure both wear resistance and toughness may be provided.

DESCRIPTION OF DRAWINGS

FIG. 1 is optical microscope images of a microstructure before and after a heat treatment of inventive steel 4.

BEST MODE FOR INVENTION

Hereinafter, preferable example embodiments of the present disclosure will be described.

However, the example embodiments may be provided to more completely describe the present disclosure to a person having ordinary knowledge in the art.

Also, the example embodiments of the present disclosure may be modified in various manners, and a scope of the present disclosure is not limited to embodiments described below.

Also, in the specification, the term "comprise" may indicate that a certain element may further be included, not excluding another element, unless otherwise indicated.

In the description below, an austenitic steel material having excellent wear resistance and toughness according to an example embodiment of the present disclosure will be described in detail.

An austenitic steel material having excellent wear resistance and toughness according to an aspect of the present disclosure may comprise, by wt %, 0.6 to 1.9% of carbon (C), 12 to 22% of manganese (Mn), 5% or less of chromium (Cr) (excluding 0%), 5% or less of copper (Cu) (excluding 0%), 0.5% or less of aluminum (Al) (excluding 0%), 1.0% or less of silicon (Si) (excluding 0%), 0.1% or less of phosphorous (P) (including 0%), 0.02% or less of sulfur (S) (including 0%), and a balance of Fe and inevitable impurities, and the austenitic steel material may include, by an area fraction, austenite of 97% or higher (including 100%) and carbides of 3% or lower (including 0%), as a microstructure.

A composition and composition ranges of the steel material will be described.

Carbon (C): 0.6 to 1.9 wt % (Hereinafter, Referred to as "%")

It may be preferable to limit a content of carbon (C) to 0.6 to 1.9%.

Carbon is an austenite stabilizing element which may improve a uniform elongation rate, and may be advantageous to improving strength and process hardenability.

When a content of carbon is less than 0.6%, it may be difficult to form stable austenite at room temperature such that there may be the problem in which it may be difficult to secure sufficient strength and process hardenability.

When a content of carbon exceeds 1.9%, a large amount of carbides may be precipitated such that a uniform elongation rate may decrease, and it may thus be difficult to secure an excellent elongation rate. Also, wear resistance may degrade, and early breakage may occur.

To improve wear resistance, it may be preferable to increase a content of carbon. However, even though the precipitation of carbides is prevented through a heat treatment, there may be a limitation in solid solution of carbon, and there may be a risk of deterioration of properties of the steel material. Thus, it may be preferable to limit an upper limit content of carbon to be 1.9%.

A more preferable content of carbon may be 0.7 to 1.7%.

Manganese (Mn): 12 to 22%

It may be preferable to limit a content of manganese to be 12 to 22%.

Manganese is an important element which may stabilize austenite, and may improve a uniform elongation rate.

It may be preferable to include 12% or higher of manganese to obtain austenite as a main structure in the steel material of the present disclosure.

When a content of manganese is less than 12%, stability of austenite may degrade such that a martensite structure may be formed during a rolling process in a manufacturing process, and accordingly, a sufficient austenite structure may not be secured, such that it may be difficult to secure a sufficient uniform elongation rate.

When a content of manganese exceeds 22%, manufacturing costs may greatly increase, corrosion resistance may degrade due to the excessive addition of manganese, and internal oxidation may occur greatly during heating in a manufacturing process such that the problem of degradation of surface quality may occur.

Copper (Cu): 5% or Less (Excluding 0%)

It may be preferable to limit a content of copper (Cu) to be 5% or less.

Copper may have a significantly low solid solution degree in carbides, and may slowly disperse in austenite such that copper may be concentrated on a carbide interfacial surface nucleated with austenite. Accordingly, copper may interfere with dispersion of carbon such that copper may effectively slow down the growth of carbides, and may thus have an effect of preventing the formation of carbides. In the present disclosure, to obtain such an effect, copper may be added, and a preferable content of copper to obtain the effect of preventing carbides may be 0.05% or higher.

Copper may also improve corrosion resistance of the steel material. When a content of copper exceeds 5%, hot press workability of the steel may degrade. Thus, it may be preferable to limit an upper limit content of copper to be 5%.

A more preferable content of copper may be 4% or less.

Chromium (Cr): 5% or Less (Excluding 0%)

It may be preferable to limit a content of chromium (Cr) to be 5% or less.

When an appropriate content of chromium is added, chromium may be solute in austenite and may increase strength of the steel material.

Chromium is also an element which may improve corrosion resistance of the steel material. However, chromium may decrease toughness by forming carbides on an austenite grain boundary.

Thus, it may be preferable to determine a content of chromium to be added in the present disclosure in consideration of relationships with carbon and other elements to be added. It may be preferable to limit an upper limit content of chromium to be 5% to prevent the formation of carbides.

When a content of chromium exceeds 5%, it may be difficult to effectively prevent the formation of chromium-based carbides on an austenite grain boundary, and accordingly, impact toughness may decrease.

A more preferable content of chromium may be 4% or less.

Aluminum (Al): 0.5% or Less (Excluding 0%) and Silicon (Si): 1.0% or Less (Excluding 0%)

Aluminum (Al) and silicon (Si) are elements which may be added as deoxidizers during a steelmaking process. The steel material of the present disclosure may include aluminum (Al) and silicon (Si) within the above-mentioned composition ranges limited as above.

Phosphorous (P): 0.1% or Less (Including 0%) and Sulfur (S): 0.02% or Less (Including 0%)

Phosphorous (P) and sulfur (S) are representative impurities. Excessive addition of phosphorous and sulfur may cause quality degradation. Thus, it may be preferable to limit a content of phosphorous to be 0.1% or less and a content of sulfur to be 0.02% or less.

The steel material of the present disclosure may include a remainder of Fe and other inevitable impurities.

In a general manufacturing process, inevitable impurities may be inevitably added from raw materials or a surrounding environment, and thus, impurities may not be excluded.

A person skilled in the art may be aware of the impurities, and thus, the descriptions of the impurities may not be provided in the present disclosure.

The austenitic steel material having excellent wear resistance and toughness according to a preferable aspect of the present disclosure may have a microstructure including, by an area fraction, austenite of 97% or higher (including 100%), and carbides of 3% or lower (including 0%).

When a fraction of carbides exceeds 3%, carbides may be precipitated on an austenite grain boundary, which may cause breakage of a grain boundary, and impact toughness of the steel material may greatly decrease.

Thus, it may be preferable to limit a fraction of carbides to be 3% or lower in area fraction.

Thus, when a fraction of carbides satisfies 3% or lower in area fraction, excellent strength and elongation rate of an austenite-based steel material may be secured, which are unique characteristics of an austenite-based steel material, and process hardenability may improve such that hardness may increase due to process hardening of the material, thereby securing excellent wear resistance.

Preferably, a grain size of austenite may be 500 μm or less.

As a microstructure of the steel material is formed of carbides of 3% or lower in area fraction and an austenite structure having a gain size of 500 μm or less, the steel material having improved wear resistance and toughness may be provided.

A preferable thickness of the austenite steel material may be 4 mm or higher, and a more preferable thickness may be 4 to 50 mm.

The austenite steel material may have a wear amount of 2.0 g or less and impact toughness of 100 J or higher.

In the description below, a method of manufacturing an austenitic steel material having excellent wear resistance and toughness will be described.

The method of manufacturing an austenitic steel material having excellent wear resistance and toughness may comprise preparing a slab comprising, by wt %, 0.6 to 1.9% of carbon (C), 12 to 22% of manganese (Mn), 5% or less of chromium (Cr) (excluding 0%), 5% or less of copper (Cu) (excluding 0%), 0.5% or less of aluminum (Al) (excluding 0%), 1.0% or less of silicon (Si) (excluding 0%), 0.1% or less of phosphorous (P) (including 0%), 0.02% or less of sulfur (S) (including 0%), and a balance of Fe and inevitable impurities; reheating the slab at 1050° C. or higher; obtaining a hot-rolled steel material by hot-rolling the reheated slab at a finish rolling temperature of 800° C. or higher; and performing a heat treatment in which the hot-rolled steel material is maintained for a maintaining time (minutes) satisfying Relational Expression 2 at a heat treatment temperature (T) satisfying Relational Expression 1 below, and the hot-rolled steel material is water-cooled to 500° C. or lower at a cooling speed of 10° C./sec or higher.

$$530+285[C]+44[Cr]<T<1446-174[C]-3.9[Mn] \quad \text{[Relational Expression 1]}$$

(T is a heat treatment temperature (° C.), and [C], [Cr] and [Mn] each indicate wt % of each element)

$$t+10<\text{maintaining time}<t+30 \quad \text{[Relational Expression 2]}$$

(t is a thickness of a steel sheet (mm))

Reheating Slab

A slab may be reheated before hot-rolling the slab.

The slab may be reheated for a casting structure of the slab, segregation, solid solution and homogenization of secondary phases in the reheating process.

The slab may need to be reheated to 1050° C. or higher to secure a sufficient temperature during a hot-rolling process. Preferably, the slab may be reheated at 1050 to 1250° C.

When the reheating temperature is less than 1050° C., homogenization of the structure may not be sufficient, and a temperature of a heating furnace may significantly decrease such that deformation resistance may increase during a hot-rolling process.

When the reheating temperature exceeds 1250° C., a segregation region in a casting structure may be partially melted, and surface quality may be deteriorated.

Hot-Rolling

The reheated slab may be hot-rolled, thereby obtaining a hot-rolled steel material.

It may be preferable to limit a hot-press finish rolling temperature to be 800° C. or higher during the hot-rolling, and it may be more preferable to limit the hot-press finish rolling temperature to be 800° C. or higher and a non-recrystallization temperature (Tnr) or lower.

The steel material of the present disclosure may not accompany phase transformation, and a control of carbide precipitation may be performed in a subsequent heat treatment process. Thus, it may not be necessary to accurately control the temperature during the hot-rolling. The rolling may be performed only in consideration of a target product size, and thus, a process limitation in relation to a temperature control may be resolved. However, if the rolling is performed at an excessively low temperature, rolling load may significantly increase, and it may thus be preferable to finish the rolling at the above-mentioned temperature or higher.

Through the hot-rolling, a hot-rolled steel material having a thickness of 4 to 50 mm, preferably, may be manufactured.

When a thickness of the hot-rolled steel material is 50 mm or greater, it may be difficult to machine-cut the material, and the material may need to be gas-cut. Also, a material deviation caused by a difference in degree of carbide precipitation may occur due to a cooling deviation between a surface portion and a central portion during a cooling process.

Heat Treatment Process

A heat treatment process, in which the hot-rolled steel material obtained as above may be maintained for a maintaining time (minute) satisfying Relational Expression (2) at a heat treatment temperature (T) satisfying Relational Expression (1) below, and the hot-rolled steel material may be water-cooled to 500° C. or lower at a cooling speed of 10° C./sec or higher, may be performed.

$$530+285[C]+44[Cr]<T<1446-174[C]-3.9[Mn] \quad \text{[Relational Expression 1]}$$

(T is a heat treatment temperature (° C.), and [C], [Cr] and [Mn] each indicate wt % of each element)

$$t+10<\text{maintaining time}<t+30 \quad \text{[Relational Expression 2]}$$

(t is a thickness of a steel sheet (mm))

Heat Treatment Temperature (T): 530+285[C]+44[Cr]<T<1446−174[C]−3.9[Mn]

As for the heat treatment temperature, the hot-rolled steel material may be heated at a temperature of 530+285[C]+44[Cr] or higher in which carbides may be actively solute to reduce the heat treatment time, and it may be required to maintain the hot-rolled steel material at a temperature of 1446−174[C]−3.9[Mn] or lower to prevent a segregation region from being partially melted due to excessive heating.

Heat Treatment (Minute): t+10<Maintaining Time (Minutes)<t+30

As for the heat treatment time, the hot-rolled steel material may need to be maintained for t(thickness of steel sheet)+10 minutes or longer depending on a thickness of the steel material to secure the time for sufficient solid solution of carbides. When the hot-rolled steel material is maintained for an excessive period of time, strength may decrease due to coarsening of a grain size, and thus, the maintaining time may be limited to be t (thickness of steel sheet)+10 minutes or less.

Water-Cooling: Cooling Speed of 10° C./Sec or Higher, and Cooling Stop Temperature of 500° C. or Less When the cooling speed is less than 10° C./sec, or when the cooling stop temperature exceeds 500° C., carbides may be precipitated such that an elongation rate may degrade.

A rapid cooling process may be helpful to secure a high solid solution degree of C and N in a casting structure. Thus, it may be preferable to perform the cooling to 500° C. or lower at the speed of 10° C./sec or higher.

A more preferable cooling speed may be 15° C./sec or higher, and a more preferable cooling stop temperature may be 450° C. or lower.

According to the method of manufacturing an austenitic steel material in accordance with another aspect of the present discourse, an austenitic steel material having excellent wear resistance and toughness which has a microstructure comprising, by an area fraction, austenite of 97% or higher (including 100%), and carbides of 3% or lower (including 0%), may be manufactured.

Preferably, a grain size of austenite may be 500 μm or less.

The austenite steel material may have a wear amount of 2.0 g or lower and impact toughness of 100 J or higher.

According to a preferable example embodiment of the present disclosure, toughness may improve by securing an uniform and highly stable austenite phase, a limitation in controlling carbides during a rolling process may be overcome by effectively controlling carbides through a heat treatment, and a process efficiency and quality may improve by resolving a limitation in improving toughness. Accordingly, an austenitic steel material which may be effectively applied in the fields requiring wear resistance and high toughness in the overall fields of mining, transporting, and storing or the field of industrial machines in the oil and gas industries, where a large amount of wear of the steel material occurs, may be provided.

Mode for Invention

In the description below, an example embodiment of the present disclosure will be described in greater detail. It should be noted that the exemplary embodiments are provided to describe the present disclosure in greater detail, and to not limit the scope of rights of the present disclosure. The scope of rights of the present disclosure may be determined on the basis of the subject matters recited in the claims and the matters reasonably inferred from the subject matters.

Embodiment

A slab having a composition as in Table 1 below was reheated at 1150° C., and was hot-rolled under a hot-press finish rolling temperature condition of 950° C., thereby manufacturing a hot-rolled steel material having a thickness of 12 mm. Thereafter, a heat treatment was performed on the hot-rolled steel material under a heat treatment condition as in Table 2 below, thereby manufacturing a hot-rolled steel material.

A microstructure, yield strength, a uniform elongation rate, and impact toughness of the hot-rolled steel material manufactured as above were measured, and the results were listed in Table 3 below.

Also, wear resistance of the hot-rolled steel material was measured, and the result was also listed in Table 3 below. As for the wear resistance test, a wear test was conducted in accordance with G65 regulations of American society of testing materials International (ASTM), and an amount of wear of the steel material was measured. In Table 3, "not conducted" indicates that the wear test was not conducted, and as strength, an elongation rate, and impact toughness were already deteriorated, an additional wear test was not conducted.

Also, images of microstructures of inventive steel 4 before and after a heat treatment were observed, and the results were listed in Table 1.

TABLE 1

| | Element Composition (weight %) | | | | | | | |
|---|---|---|---|---|---|---|---|---|
| Classification | C | Mn | Si | Al | Cr | Cu | P | S |
| Inventive Steel 1 | 0.63 | 21.1 | 0.43 | 0.035 | 4.8 | 3.8 | 0.031 | 0.005 |
| Inventive Steel 2 | 0.91 | 16.5 | 0.07 | 0.055 | 1.2 | 1.6 | 0.024 | 0.011 |
| Inventive Steel 3 | 0.79 | 18.1 | 0.015 | 0.121 | 2.7 | 4.2 | 0.022 | 0.005 |
| Inventive Steel 4 | 1.18 | 19.4 | 0.21 | 0.039 | 3.4 | 0.05 | 0.018 | 0.005 |
| Inventive Steel 5 | 1.83 | 12.3 | 0.085 | 0.264 | 0.04 | 0.3 | 0.011 | 0.015 |
| Comparative Steel 1 | 0.32 | 19.3 | 0.017 | 0.078 | 0.023 | 0.025 | 0.015 | 0.009 |
| Comparative Steel 2 | 1.94 | 16.8 | 0.098 | 0.046 | 0.11 | 0.1 | 0.016 | 0.004 |
| Comparative Steel 3 | 0.38 | 11.4 | 0.046 | 0.039 | 0.22 | 0.15 | 0.015 | 0.005 |

TABLE 1-continued

| Classification | Element Composition (weight %) | | | | | | | |
|---|---|---|---|---|---|---|---|---|
| | C | Mn | Si | Al | Cr | Cu | P | S |
| Comparative Steel 4 | 1.09 | 19.6 | 0.15 | 0.078 | 5.6 | 0.09 | 0.017 | 0.008 |
| Comparative Steel 5 | 1.52 | 16.5 | 0.11 | 0.043 | 1.8 | 0.9 | 0.016 | 0.007 |
| Comparative Steel 6 | 1.52 | 16.5 | 0.11 | 0.043 | 1.8 | 0.9 | 0.016 | 0.007 |
| Comparative Steel 7 | 1.52 | 16.5 | 0.11 | 0.043 | 1.8 | 0.9 | 0.016 | 0.007 |
| Comparative Steel 8 | 1.52 | 16.5 | 0.11 | 0.043 | 1.8 | 0.9 | 0.016 | 0.007 |
| Comparative Steel 9 | 1.52 | 16.5 | 0.11 | 0.043 | 1.8 | 0.9 | 0.016 | 0.007 |
| Comparative Steel 10 | 1.52 | 16.5 | 0.11 | 0.043 | 1.8 | 0.9 | 0.016 | 0.007 |

TABLE 2

| Classification | Heat Treatment Conditions | | | |
|---|---|---|---|---|
| | Temperature (° C.) | Time (minutes) | Cooling Speed(° C./s) | Cooling Stop Temperature (° C.) |
| Inventive Steel 1 | 951 | 25 | 70 | 320 |
| Inventive Steel 2 | 905 | 25 | 72 | 320 |

TABLE 2-continued

| Classification | Heat Treatment Conditions | | | |
|---|---|---|---|---|
| | Temperature (° C.) | Time (minutes) | Cooling Speed(° C./s) | Cooling Stop Temperature (° C.) |
| Inventive Steel 3 | 907 | 25 | 70 | 310 |
| Inventive Steel 4 | 1022 | 25 | 69 | 250 |
| Inventive Steel 5 | 1056 | 25 | 75 | 180 |
| Comparative Steel 1 | 899 | 25 | 73 | 270 |
| Comparative Steel 2 | 1090 | 25 | 65 | 250 |
| Comparative Steel 3 | 900 | 25 | 74 | 300 |
| Comparative Steel 4 | 1100 | 25 | 71 | 240 |
| Comparative Steel 5 | 852 | 25 | 72 | 250 |
| Comparative Steel 6 | 1185 | 25 | 70 | 250 |
| Comparative Steel 7 | 1055 | 5 | 67 | 150 |
| Comparative Steel 8 | 1055 | 75 | 72 | 190 |
| Comparative Steel 9 | 1055 | 25 | 3.8 | 320 |
| Comparative Steel 10 | 1055 | 25 | 65 | 650 |

TABLE 3

| Classification | Microstructure (γ; Austenite) | Yield Strength (MPa) | Uniform Elongation Rate (%) | Impact Toughness (J) | Amount of Water (g) |
|---|---|---|---|---|---|
| Inventive Steel 1 | 3% or less of γ+Carbide | 408 | 51 | 223 | 1.54 |
| Inventive Steel 2 | 3% or less of γ+Carbide | 382 | 49 | 198 | 1.81 |
| Inventive Steel 3 | 3% or less of γ+Carbide | 392 | 53 | 168 | 1.79 |
| Inventive Steel 4 | 3% or less of γ+Carbide | 468 | 45 | 236 | 1.67 |
| Inventive Steel 5 | 3% or less of γ+Carbide | 505 | 41 | 150 | 1.45 |
| Comparative Steel 1 | 3% or less of γ+Carbide | 268 | 55 | 126 | 2.63 |
| Comparative Steel 2 | 19% of γ+Carbide | 524 | 12 | 31 | Not Conducted |
| Comparative Steel 3 | γ+Martenside | 278 | 23 | 22 | Not Conducted |
| Comparative Steel 4 | 12% of γ+Carbide | 496 | 20 | 39 | Not Conducted |
| Comparative Steel 5 | 7% of γ+ Carbide 7% | 490 | 27 | 47 | Not Conducted |
| Comparative Steel 6 | 8% of γ+ Carbide 8% | 490 | 23 | 46 | Not Conducted |
| Comparative Steel 7 | 9% of γ+ Carbide | 512 | 19 | 32 | Not Conducted |
| Comparative Steel 8 | 3% or less of γ+ Carbide | 274 | 47 | 249 | 2.88 |
| Comparative Steel 9 | 9% of γ+ Carbide | 482 | 26 | 41 | Not Conducted |
| Comparative Steel 10 | 10% of γ+ Carbide | 477 | 23 | 39 | Not Conducted |

As indicated in Tables 1 to 3, inventive steels 1 to 5 which satisfied overall composition systems and manufacturing conditions of the present disclosure had the amount of wear of 2.0 g or less, which is excellent wear resistance, and secured impact toughness of 100 J or higher.

As for comparative steel 1, sufficient strength was not secured as a content of carbon was significantly low. Accordingly, the amount of wear exceeded 2.0 g, a reference value. In comparative steel 2, carbides increased due to excessive addition of carbon, and accordingly, comparative steel 2 had low impact toughness.

As for comparative steel 3, a stable austenite phase was not formed due to insufficient content of manganese, and as martensite was formed, comparative steel 3 had low impact toughness. Also, comparative steel 4 had low impact toughness due to excessive content of chromium.

Comparative steels 5 to 10 did not satisfy the heat treatment condition ranges such that comparative steels 5 to 10 had low impact toughness due to excessive residue and precipitation of carbides. Also, when the heat treatment was excessively performed, strength decreased due to coarsening of an austenite grain such that wear resistance decreased.

Also, as indicated in FIG. 1 showing microstructure images of inventive steel 4 before and after the heat treatment, in the hot-rolled steel material before the heat treatment, carbides were precipitated along the austenite grain boundary, but after the heat treatment, a fully austenitic structure with sufficient solute carbides was obtained.

While exemplary embodiments have been shown and described above, the scope of the present disclosure is not limited thereto, and it will be apparent to those skilled in the art that modifications and variations could be made without departing from the scope of the present invention as defined by the appended claims.

The invention claimed is:

1. A method of manufacturing an austenitic steel sheet, comprising:

preparing a slab comprising, by wt %, 0.6 to 1.9% of carbon, 12 to 22% of manganese, 5% or less of chromium, excluding 0%, 5% or less of copper, excluding 0%, 0.5% or less of aluminum, excluding 0%, 1.0% or less of silicon, excluding 0%, 0.1% or less of phosphorous, including 0%, 0.02% or less of sulfur, including 0%, and a balance of Fe and inevitable impurities;

reheating the slab at 1050° C. or higher;

obtaining a hot-rolled steel sheet by hot-rolling the reheated slab at a finish rolling temperature of 800° C. or higher; and performing a heat treatment in which the hot-rolled steel sheet is maintained for a maintaining time, in minutes, satisfying Relational Expression 2, at a heat treatment temperature, T, satisfying Relational Expression 1 below, and the hot-rolled steel sheet is water-cooled to 500° C. or lower at a cooling speed of 15° C./sec or higher, wherein the steel sheet has a microstructure comprising, by an area fraction, austenite of 97% or higher, including 100%, and carbides of 3% or lower, including 0%, and wherein the steel sheet has a wear amount of 2.0 g or less and an impact toughness of 100 J or higher, $$530+285[C]+44[Cr]<T<1446-174[C]-3.9[Mn] \quad \text{[Relational Expression 1]}$$

where T is a heat treatment temperature, in ° C., and [C], [Cr] and [Mn] each indicate wt % of each element, $$t+10<\text{maintaining time}<t+30 \quad \text{[Relational Expression 2]}$$

where t is a thickness of the hot-rolled steel sheet in mm.

2. The method of claim 1, wherein a temperature of the reheating the slab is 1050 to 1250° C.

3. The method of claim 1, wherein the finish rolling temperature of the hot-rolling is 800° C. or higher and a non-recrystallization temperature, Tnr, or lower.

4. The method of claim 1, wherein the thickness of the hot-rolled steel sheet is 4 to 50 mm.

5. The method of claim 1, wherein a grain size of austenite is 500 μm or less.

6. The method of claim 1, wherein the steel sheet has a wear amount of less than 2.0 g and an impact toughness of higher than 100 J.

* * * * *